US009777543B2

(12) United States Patent
Ellis

(10) Patent No.: US 9,777,543 B2
(45) Date of Patent: Oct. 3, 2017

(54) DEVICE AND METHOD FOR MULTI-PATH FLOW FROM VERTICAL HYDRAULIC TANK

(71) Applicant: Vertical Tank, Inc., Bakersfield, CA (US)

(72) Inventor: Stan Ellis, Bakersfield, CA (US)

(73) Assignee: Vertical Tank, Inc., Bakersfield, CA (US)

( * ) Notice: Subject to any disclaimer, the term of this patent is extended or adjusted under 35 U.S.C. 154(b) by 30 days.

(21) Appl. No.: 14/469,497

(22) Filed: Aug. 26, 2014

(65) Prior Publication Data

US 2015/0059858 A1 Mar. 5, 2015

Related U.S. Application Data

(60) Provisional application No. 61/870,726, filed on Aug. 27, 2013.

(51) Int. Cl.

| | |
|---|---|
| ***E21B 21/01*** | (2006.01) |
| ***B65D 88/54*** | (2006.01) |
| ***E21B 21/10*** | (2006.01) |
| ***B65D 88/32*** | (2006.01) |

(52) U.S. Cl.

CPC ..... *E21B 21/01* (2013.01); *B65D 88/32* (2013.01); *B65D 88/54* (2013.01); *E21B 21/106* (2013.01); *Y10T 137/0318* (2015.04); *Y10T 137/86035* (2015.04); *Y10T 137/86196* (2015.04); *Y10T 137/86308* (2015.04)

(58) Field of Classification Search

CPC ..... E21B 21/01; E21B 21/106; B65D 88/32; B65D 88/54; Y10T 137/86196; Y10T 137/86308; Y10T 137/0318; Y10T 137/86035; Y10T 137/87877

See application file for complete search history.

(56) References Cited

U.S. PATENT DOCUMENTS 3,849,197 A * 11/1974 Sorrentino ..... C25D 21/20 105/150
4,901,563 A * 2/1990 Pearson ..... B01F 15/00207 166/308.1
5,964,304 A * 10/1999 Morrison, Jr. ..... E21B 21/01 175/206

(Continued)

*Primary Examiner* — Mary McManmon
*Assistant Examiner* — Patrick Williams
(74) *Attorney, Agent, or Firm* — Matthew C. McCarthy, Esq.; Eastman & McCartney LLP

(57) ABSTRACT

A vertical hydraulic tank includes an upper cylindrical section and a lower conical section, with an outlet in the lower conical section. A lower multi-path manifold is attached to the outlet, the manifold including a vertical conduit in fluid communication with the outlet and a plurality of horizontal conduits in fluid communication with the vertical conduit. An upper multi-path manifold can also be attached to the tank with a plurality of upper horizontal conduits and a vertical conduit in fluid communication with the upper cylindrical section of the tank. Valves may be provided along the vertical conduit and the horizontal conduits to regulate flow of material through the conduits. A pump may be connected to either the upper manifold or the lower manifold, or both by way of a pump conduit. Multiple tanks can be connected together by way of tubing between the manifolds of each tank.

14 Claims, 13 Drawing Sheets

(56) References Cited

U.S. PATENT DOCUMENTS

| | | | | |
|---|---|---|---|---|
| 6,468,481 | B1 * | 10/2002 | Anderson | B01F 1/0016 422/261 |
| 6,555,074 | B1 * | 4/2003 | Sweet | A47J 31/053 422/281 |
| 6,779,539 | B1 * | 8/2004 | Schwamberger | C02F 1/688 137/1 |
| 2008/0190668 | A1 * | 8/2008 | Swartout | E21B 21/065 175/207 |

* cited by examiner

DEVICE AND METHOD FOR MULTI-PATH FLOW FROM VERTICAL HYDRAULIC TANK

RELATED APPLICATIONS

This application claims the benefit of priority to the U.S. Provisional Patent Application for "DEVICE AND METHOD FOR MULTI-PATH FLOW FROM VERTICAL HYDRAULIC TANK," Ser. No. 61/870,726 filed on Aug. 27, 2013.

FIELD OF THE INVENTION

The present invention relates generally to a vertical hydraulic tank, and more specifically to a vertical hydraulic tank with a conical bottom, a lower manifold attached to an outlet on the conical bottom for multi-path flow of fluid out of the tank, and an upper manifold with an inlet to the top of the tank.

BACKGROUND OF THE INVENTION

The use of fluids at a job site is well known, particularly in the oil and gas industry. Fluids commonly known as "drilling mud" are widely used for drilling bore holes. Fracturing fluids are used for hydraulic fracturing or "tracking" processes. Use of such fluids at a job site requires on-site fluid storage and delivery facilities. A variety of fluid storage tanks are commonly used for such purposes across various industries.

Fluid storage tanks may be horizontal or vertical, and may be constructed from a variety of materials. Steel tanks are commonly used, as are inflatable tanks that are more easily transported to a job site. Horizontal tanks, including inflatable horizontal tanks, tend to occupy a great deal of space, and this is not always desirable or practical at a job site. At sites where space is more limited, vertical tanks are commonly used.

Steel vertical tanks are common, typically having an inlet path allowing flow into the tank, and an outlet for allowing flow out of the tank. Such tanks are used individually, and when the tank and connections are fully assembled, the direction of flow to and from the tank is limited.

It is commonplace in drilling practices in the oil and gas industry to switch from water based drilling mud to oil based drilling mud. Conventional tanks must be cleaned by hand, with persons working inside the tank, to ensure removal of all water based drilling mud from the tank before oil based mud can be introduced into the tank. During the cleaning process, the remaining drilling equipment cannot be used and is simply on standby. The rental costs of such equipment on standby is significant.

Thus, it is an object of the invention to provide a vertical tank that can be combined with other vertical tanks to form a tank array that has more storage capacity than horizontal tanks. It is another object of the invention to provide a tank that is easier to clean in the field compared to conventional tanks in order to reduce equipment and labor standby costs. It is another object of the invention to provide a vertical tank that can be accessed from multiple points to insert or remove fluid from the same.

SUMMARY OF THE INVENTION

Broadly stated, the invention consists of a vertical tank with a cone bottom with a multi-path lower manifold and a multi-math upper manifold.

More specifically, a vertical hydraulic tank includes a tank having an upper cylindrical section and a lower conical section. The lower conical section includes an outlet. A multi-path lower manifold is attached to the outlet.

The lower manifold may include a lower vertical conduit that is in fluid communication with the outlet of the vertical tank. The lower vertical conduit may include a connector at a first end of the lower vertical conduit, the connector being adapted to attach to the outlet of the vertical tank.

An opposing, second end of the lower vertical conduit may extend downward to meet a plurality of lower horizontal conduits in fluid communication therewith. Any desirable number of lower horizontal conduits may be included, though for purposes of illustration, four lower horizontal conduits are shown and described. The lower horizontal conduits provide multiple pathways from which to draw liquid from the outlet of the tank, through the lower vertical conduit, and out one or more horizontal conduits.

Each of the four lower horizontal conduits may extend away from the lower vertical conduit and terminate in a flange connector at or near the end of the lower horizontal conduit distal to the vertical conduit. Each flange connector may include a valve such that flow of material through the connector can be opened or closed as desired. A valve may also be provided between the lower vertical conduit and the outlet of the horizontal tank, to either allow or prevent the flow of material from the horizontal tank into the lower manifold.

The vertical hydraulic tank may also include an upper multi-path manifold disposed above the lower multi-path manifold. The upper manifold may include a central conduit extending around the perimeter of the conical lower section of the tank. Upper horizontal conduits may extend away from the central conduits. Any number of upper horizontal conduits may be included, though for purposes of illustration four upper horizontal conduits are shown and described.

Each of the four upper horizontal conduits may extend away from the central conduit and terminate in a flange connector at or near the end of the upper horizontal conduit distal to the central conduit. Each flange connector may include a valve such that flow of material through the connector can be opened or closed as desired.

An upper vertical conduit may be provided in fluid communication with the central conduit and extending vertically therefrom. The upper vertical conduit may also be in fluid communication with the interior of the cylindrical upper section of the vertical tank. Fluid can be introduced from a fluid source, such as a tanker truck, to one or more of the upper horizontal conduits. Fluid then travels from the upper horizontal conduits, through the central conduit, and up through upper vertical conduit and through an inlet into the interior of the vertical tank for either storage or cleaning.

The tank can also be equipped with a pump in fluid communication with the lower horizontal conduits and the central conduit of the upper manifold. Cleaning liquid can be introduced into the tank by way of one or more of the upper horizontal conduits of the upper manifold.

The tanks can be connected to one another with flexible tubing between the upper horizontal conduits of the upper manifold and the lower horizontal conduits of the lower manifold in order to form a tank array. In a preferred embodiment, a tank array includes one vertical tank with a pump with the remaining tanks simply having upper and lower manifolds.

The combination of a cone bottom tank with upper and lower manifold allows for quick cleaning of the tank when in use in the field.

BRIEF DESCRIPTION OF THE DRAWINGS

The novel features of this invention, as well as the invention itself, both as to its structure and operation, will best be understood from the accompanying drawings, taken in conjunction with the accompanying description, in which similar reference characters refer to similar parts, and in which.

DETAILED DESCRIPTION

Figure 1:
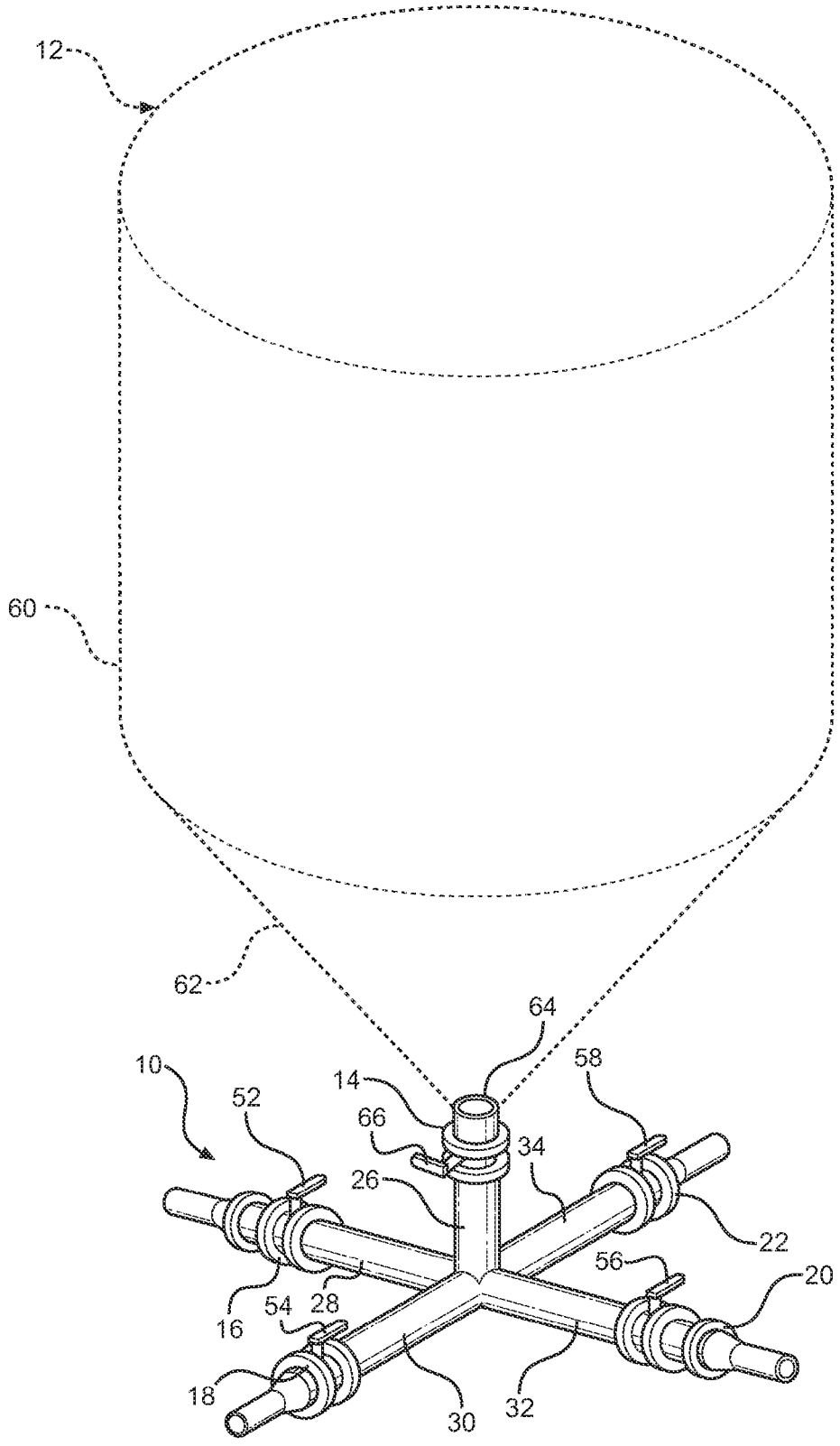
FIG. 1 is a side perspective view of one embodiment of a vertical tank with a lower multi-path manifold.

Turning to the drawings, wherein like numerals indicate like parts, FIG. 1 is a perspective view of one embodiment of a vertical hydraulic tank system of the present invention equipped with a lower manifold 10. The vertical tank 12 is shown in dashed lines to facilitate a complete view of lower manifold 10 and includes a cylindrical upper section 60 and a conical lower section 62. Conical lower section 62 terminates at an outlet 64 through which material may be passed from vertical tank 12. Positioned below vertical tank 12 is an exemplary lower manifold 10 of the present invention.

Lower multi-path manifold 10 includes a lower vertical conduit 26 having an upper end and a lower end. The upper end of lower vertical conduit 26 terminates in a connector 14. Connector 14 is adapted to mate with the structure of outlet 64, such that lower manifold 10 can be attached to vertical tank 12 and is in fluid communication with the same. A lower vertical conduit valve 66 is provided on the lower vertical conduit 26 and can be opened or closed to either allow flow of material from vertical tank 12 into the lower manifold 10 or to prevent that flow of material into the lower manifold 10.

Four lower horizontal conduits 28, 30, 32, and 34 meet at the bottom of lower end of lower vertical conduit 26. The horizontal conduits 28, 30, 32 and 34 are each in fluid communication with lower vertical conduit 26, such that material flowing from vertical tank 12 into lower vertical conduit 26 can flow into one or more of the lower horizontal conduits 28, 30, 32 and 34. Once material has flowed into one of the lower horizontal conduits 28, 30, 32 or 34 it can be directed to one or more other vertical tanks or other desired locations, as set forth.

Each of lower horizontal conduits 28, 30, 32, and 34 includes a corresponding flange connector 16, 18, 20 and 22 respectively. The flange connectors 16, 18, 20 and 22 are attached to the ends of the lower horizontal conduits 28, 30, 32 and 34 to allow additional conduits or flexible tubing 96 (not shown in this Figure) to be connected to one or more of the horizontal conduits 28, 30, 32 or 34, thereby providing a path for material flow away from vertical tank 12. Each of the flange connectors 16, 28, 20 and 22 also includes a corresponding horizontal conduit valve 52, 54, 56 and 58 respectively. The horizontal conduit valves 52, 54, 56 and 58 may be open or closed in various combinations to prevent flow from the horizontal conduits 28, 30, 32 and 34; to direct flow of a material from one or more horizontal conduits to another destination, such as a second vertical tank, a mud mixing station, a tanker truck or a drilling mud pit; or to receive material from another material source, such as another vertical tank, a tanker truck or a mud mixing station. It is to be appreciated that the connectors contemplated herein are not limited to flange style connectors, but include a wide variety of coupling connectors known in the art.

As shown in FIG. 1, each of the lower horizontal conduits 28, 30, 32, and 34 are at ninety-degree angles to the two adjacent conduits. It should be understood, however, that the lower horizontal conduits 28, 30, 32 and 34 can extend away from lower vertical conduit 26 at any desired angles. It should also be understood that the present invention is not limited to four lower horizontal conduits when more or less horizontal conduits could be used within the spirit of this invention.

Figure 2:
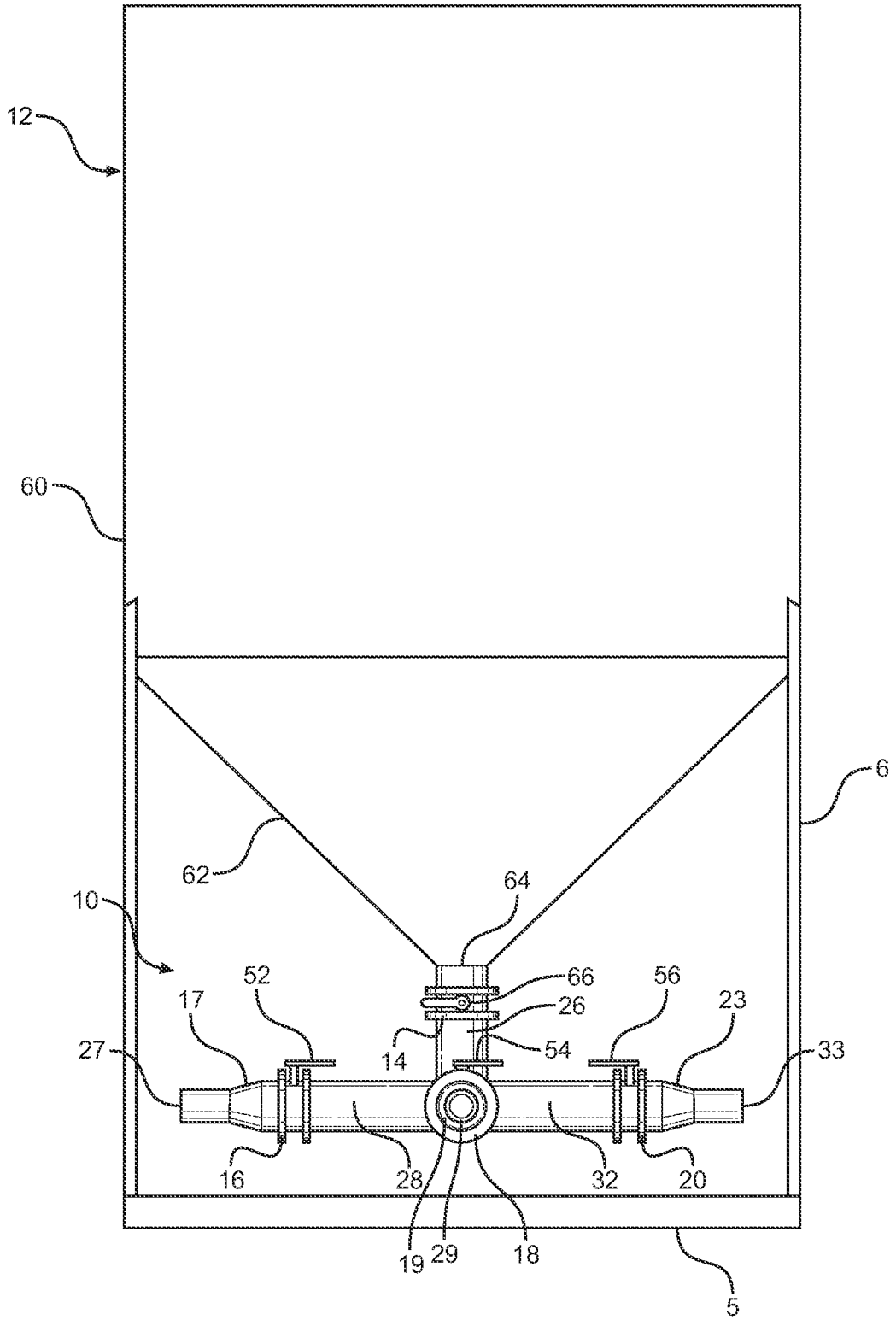
FIG. 2 is a side elevation view of the vertical tank of FIG. 1.

FIG. 2 shows the device of FIG. 1 from a side elevation view, with some of the various components described above with respect to FIG. 2 visible. In addition, Tank 12 is shown with solid lines and is also shown suspended over a base 5 and connected to base 5 with a frame 6. The base 5 and frame 6 provide a stable platform to suspend the lower manifold 10 above the ground (not shown). Horizontal conduits 28 and 32 each have a taper 17, 19, 21 and 23 and a tip 27, 29, 31 and 33 (note taper 21 and tip 31 not visible in FIG. 2). The tapers 17, 19, 21 and 23 facilitate connecting a flexible tubing 96 (not shown) or other pipe style device to receive material or fluid from the horizontal conduits 28, 30, 32 and 34.

Figure 3:
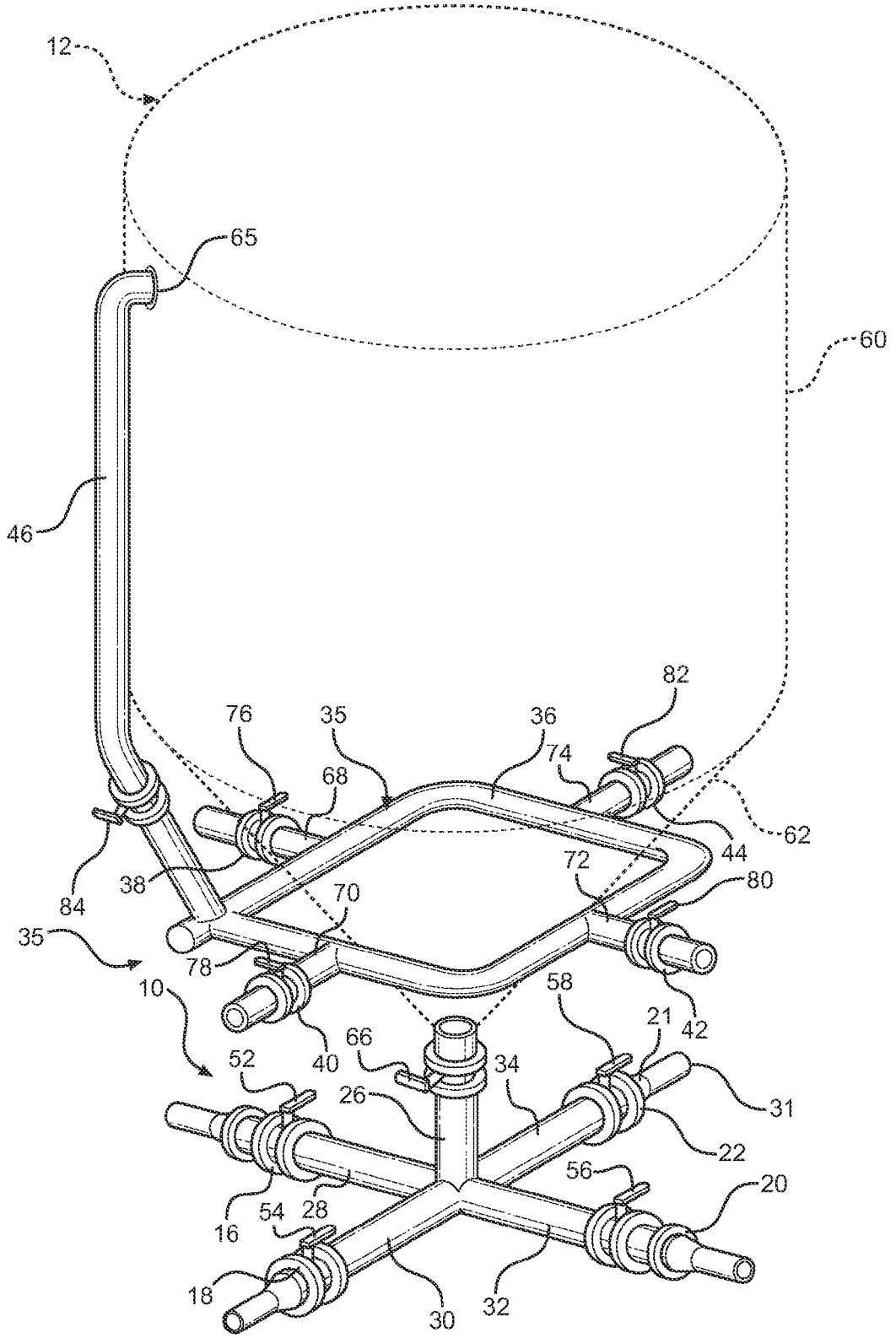
FIG. 3 is a side perspective view of an embodiment of a vertical tank with lower manifold, the vertical tank also including an upper multi-path manifold.

In some embodiments of the present invention, a multi-path upper manifold 35 is also provided. As shown in FIG. 3, multi-path upper manifold 35 is preferably located above lower manifold 10 and is not in direct fluid communication therewith.

Multi-path upper manifold 35 preferable includes a central conduit 36, which extends around the perimeter of conical lower portion 62 of vertical tank 12. Central conduit 36 may be roughly square, as shown in FIG. 3, or may be circular or provided in any other suitable shape. Extending away from central conduit 36 are a number of upper horizontal conduits 68, 70, 72, and 74. The upper horizontal conduits 68, 70, 72 and 74 are in fluid communication with central conduit 36.

Each of upper horizontal conduits 68, 70, 72, and 74 includes a corresponding upper conduit connector 38, 40, 42, and 44, respectively. These upper conduit connectors 38, 40, 42 and 44 each include an upper horizontal conduit valve 76, 78, 80, and 82 respectively, which can be opened or closed to control the flow of material into or out of the upper horizontal conduits 68, 70, 72 and 74. Thus, by operation of the upper horizontal conduit valves 76, 78, 80 and 82, a user may also control flow of material or fluid into central conduit 36 or out of central conduit 36. Material may flow into central conduit 36 from any desired location, through one or more of upper conduit connectors 38, 40, 42, or 44 by connecting flexible tubing 96 (shown in FIGS. 6*a* through 9) between a source of material such as a tanker truck 95 (shown in FIGS. 6*a* and 6*b*), mud mixing station 97 (shown in FIGS. 7 through 8) or a second vertical tank (shown in FIGS. 6 through 9) and one or more upper conduit connectors 38, 40, 42 or 44.

In an embodiment, central conduit 36 is also in fluid communication with an upper vertical conduit 46, which extends from the central conduit 36. Upper vertical conduit 46 preferably extends upward to at or near the top of vertical tank 12, whereupon upper vertical conduit 46 opens into the interior of vertical tank 12 by way of an inlet 65.

Figure 4:
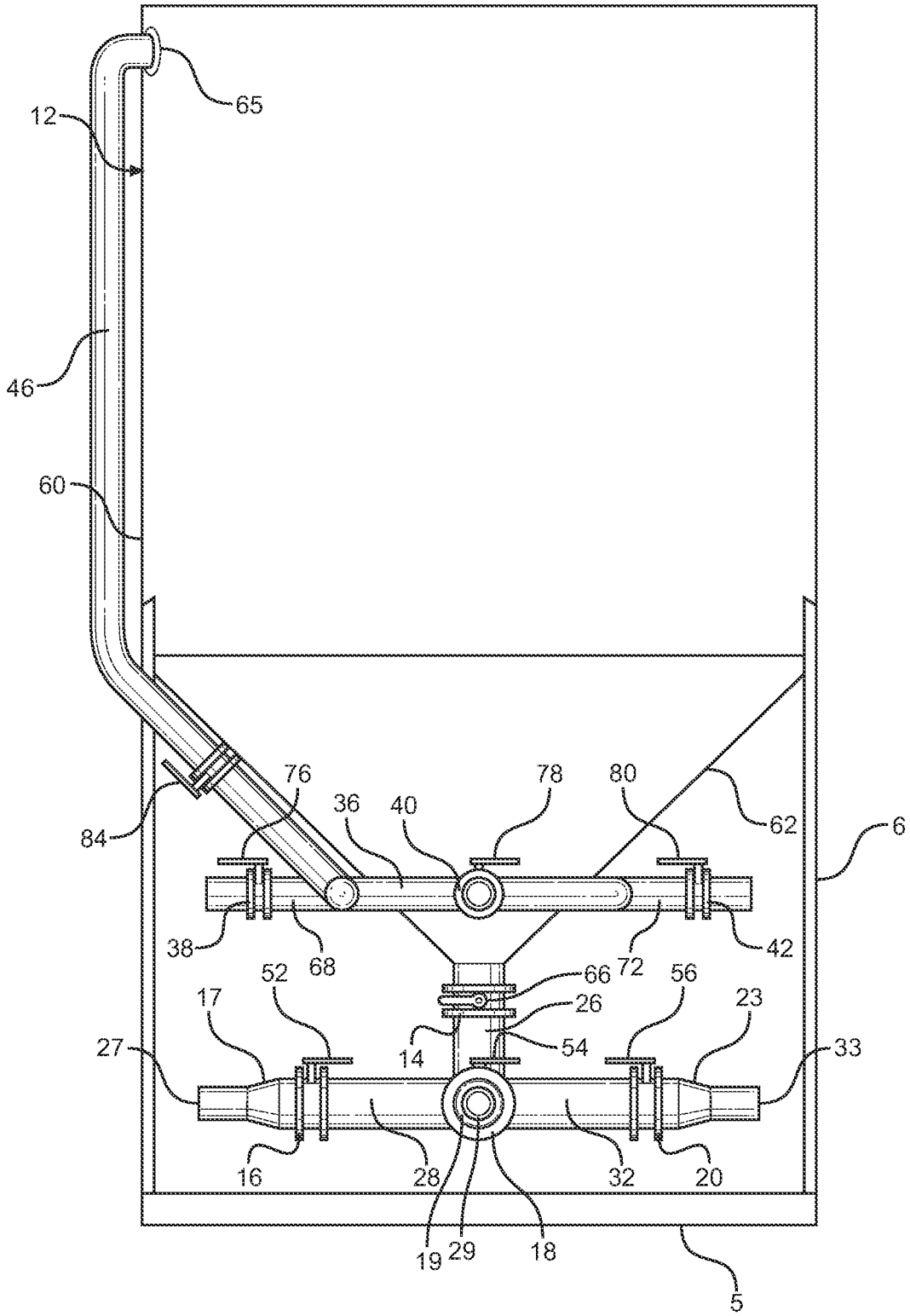
FIG. 4 is a side elevation view of the vertical tank of FIG. 3.

FIG. 4 shows the device of FIG. 3 from a side elevation view, with the various components described above with respect to FIG. 3 visible. An upper vertical conduit valve 84 is in fluid communication with the upper vertical conduit 46 and can be opened and closed to control the flow of material from the central conduit 36 through the upper vertical conduit 46 and into the interior of the vertical tank 12.

Figure 5:
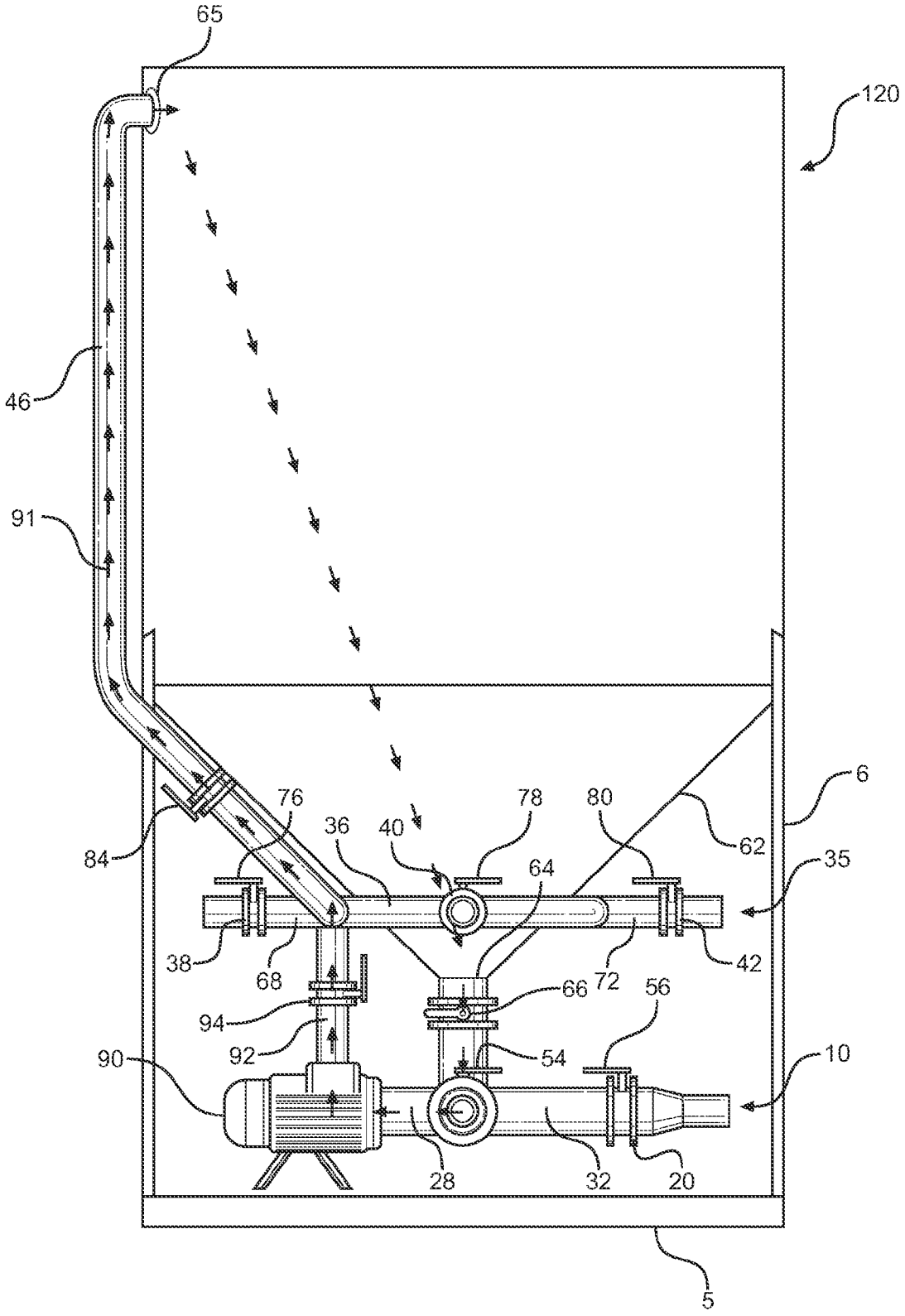
FIG. 5 is a side view of a vertical tank equipped with a lower manifold, an upper multi-path manifold and a pump and showing the path of circulation of fluid through the vertical tank during a cleaning cycle.

FIG. 5 is a side view of an alternative embodiment of a vertical tank 120 equipped with a lower manifold 10, an upper manifold 35 and a pump 90. The pump 90 is connected to horizontal conduit 28 in lieu of taper 17 and tip 27 and is in fluid communication with the lower horizontal conduits 28, 30, 32 and 34 of the lower manifold 10. The pump 90 is also in fluid communication with the central conduit 36 of the upper manifold 35 by way of the pump conduit 92. A pump conduit valve 94 is in fluid communication with the pump conduit 90. When the pump conduit valve 94 is closed, no fluid or material can pass from the lower manifold 10 to the upper manifold 35. When the pump conduit valve 94 is open, fluid or material can pass from the lower manifold 10 to the upper manifold 35.

Figure 6A:
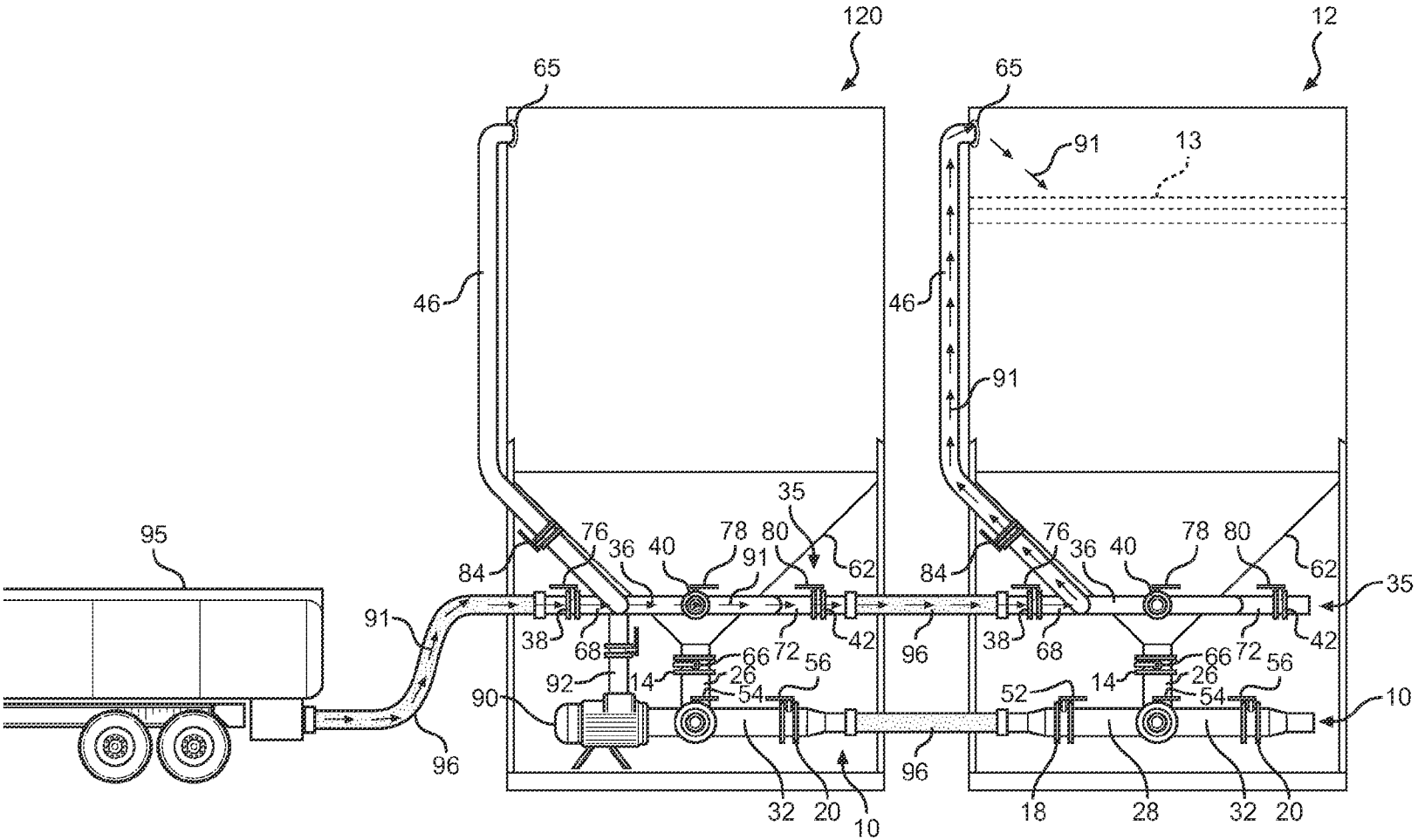
FIG. 6*a* is a side view of a plurality of vertical tanks having upper and lower manifolds and showing the pathway of drilling fluid from a truck to a first vertical tank in order to fill the first vertical tank.
Figure 6B:
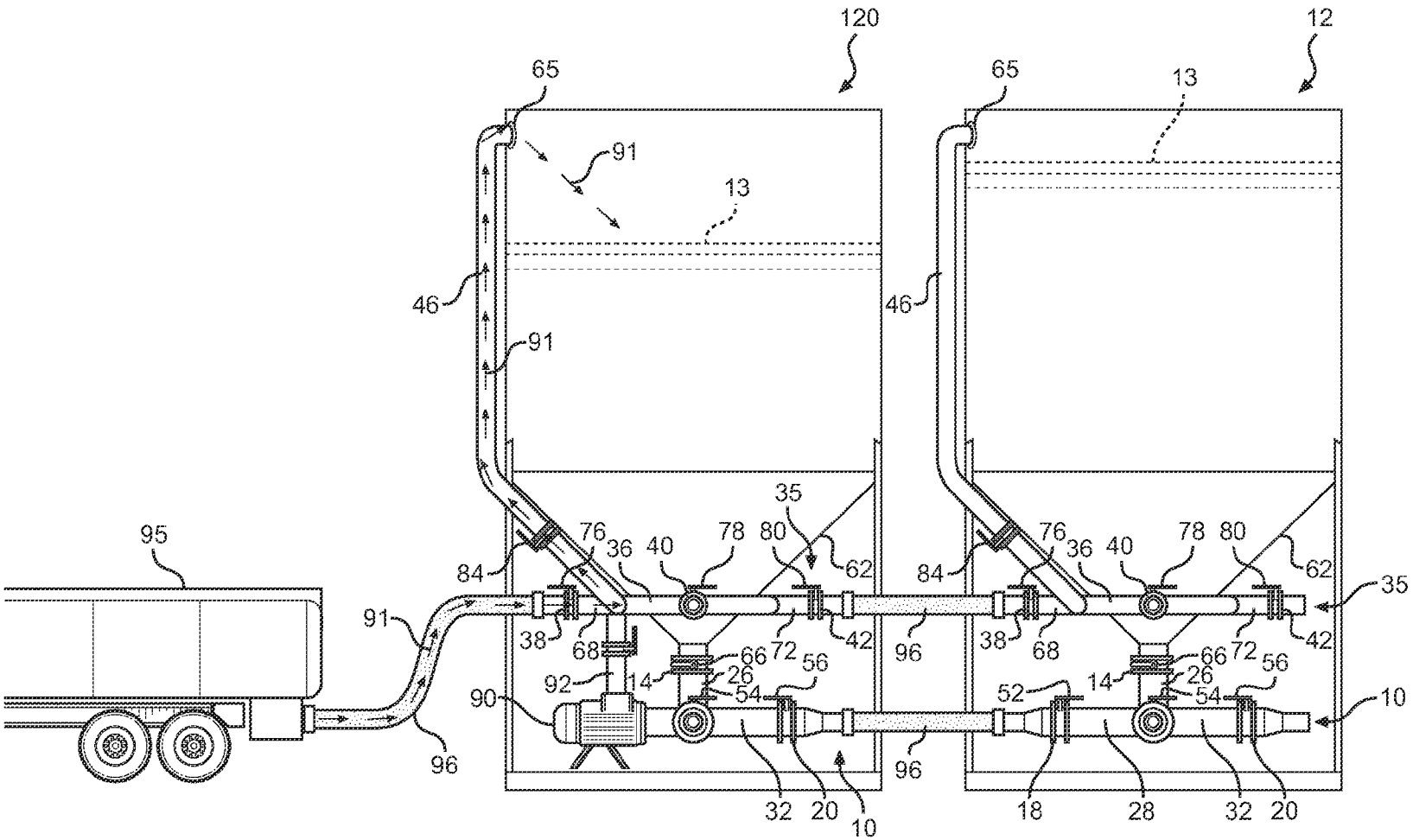
FIG. 6*b* is a side view of a plurality of vertical tanks having upper and lower manifolds and showing the pathway of drilling fluid from a truck to a second vertical tank, through the upper manifold of the first vertical tank in order to fill the second vertical tank.

As can be seen in FIG. 5, the tank 120 can be configured to engage in a cleaning cycle during which a clean fluid can circulate through the tank 120 in a closed loop. Cleaning liquid can be introduced into the tank by way of the upper manifold by connecting a fluid source, such as a tanker truck (not shown), to one of the upper horizontal conduits (68, 70, 72 or 74) of an upper manifold 35. (As can be seen in FIGS. 6A and 6B) To conduct a cleaning cycle, the valves 66, 94, and 84 are each placed in the open position with all remaining valves being placed in the closed position. Once so configured, pump 90 draws cleaning fluid (not shown) along a pathway 91 from the outlet 64 of tank 120, through the lower manifold 10, through the pump 90, through the pump conduit 92, through the central conduit 36, through the upper vertical conduit 46, and finally back into the inlet tank 65 of the tank 120. As configured, the cleaning fluid will continue to circulate through the tank 120 until the tank 120 is clean. Such a cleaning cycle allows the tank 120 to quickly be cleaned when switching from water based drilling mud to oil based drilling mud.

FIG. 6*a* is a side view of a first tank 12 configured with an upper manifold 35 and a lower manifold 10 connected to a second tank 120 configured with an upper manifold 35, a lower manifold 10 and a pump 90. A tanker truck 95 is connected to the second tank 120 by way of a flexible tubing 96 or other flexible piping to upper horizontal conduit 68 and secured with the upper horizontal conduit connector 38. Using the upper manifolds 35 of the first tank 12 and second tank 120, material can be delivered from the tanker truck 95 to the first tank 12, even when the tanker truck 95 cannot be directly connected to the first tank 12. In FIG. 6*a*, valves 76 and 84 of the first tank 12 and valves 76 and 80 of the second rank 120 are each in the open position while all other valves in the first tank 12 and second tank 120 are in the dosed position A flexible tubing 96 connects upper horizontal conduit 68 of the first rank 12 to the upper horizontal conduit 72 of the second tank 120 and allows the upper manifold 35 of the first tank 12 to be in fluid communication with the upper manifold 35 of the second tank 120. Once so configured, the tanker truck 95 is in fluid communication with the manifold 35 of the first tank 12 through the upper manifold 35 of the second tank 120 and can deliver material along pathway 91, raising the level 13 of the material in the first tank 12.

FIG. 6*b* is a side view of a first tank 12 configured with an upper manifold 35 and a lower manifold 10 connected to a second tank 120 configured with an upper manifold 35, a lower manifold 10 and a pump 90. A tanker truck 95 is connected to the second tank 120 by way of a flexible tubing 96 or other flexible piping to upper horizontal conduit 68 and secured with the upper horizontal conduit connector 38. After the first tank 12 is filled with material as set forth above, a user simply has to dose valve 80 of the second tank 120 and also open valve 84 of the second tank 120. Once so configured, material can flow along pathway 91 from tanker truck 95 through the flexible tubing 96, into the upper horizontal conduit 68 of the upper manifold 35 of the second tank, into the upper vertical conduit 46, through the inlet 65 and into the second tank 120 to fill the tank 120 to level 13.

Figure 7:
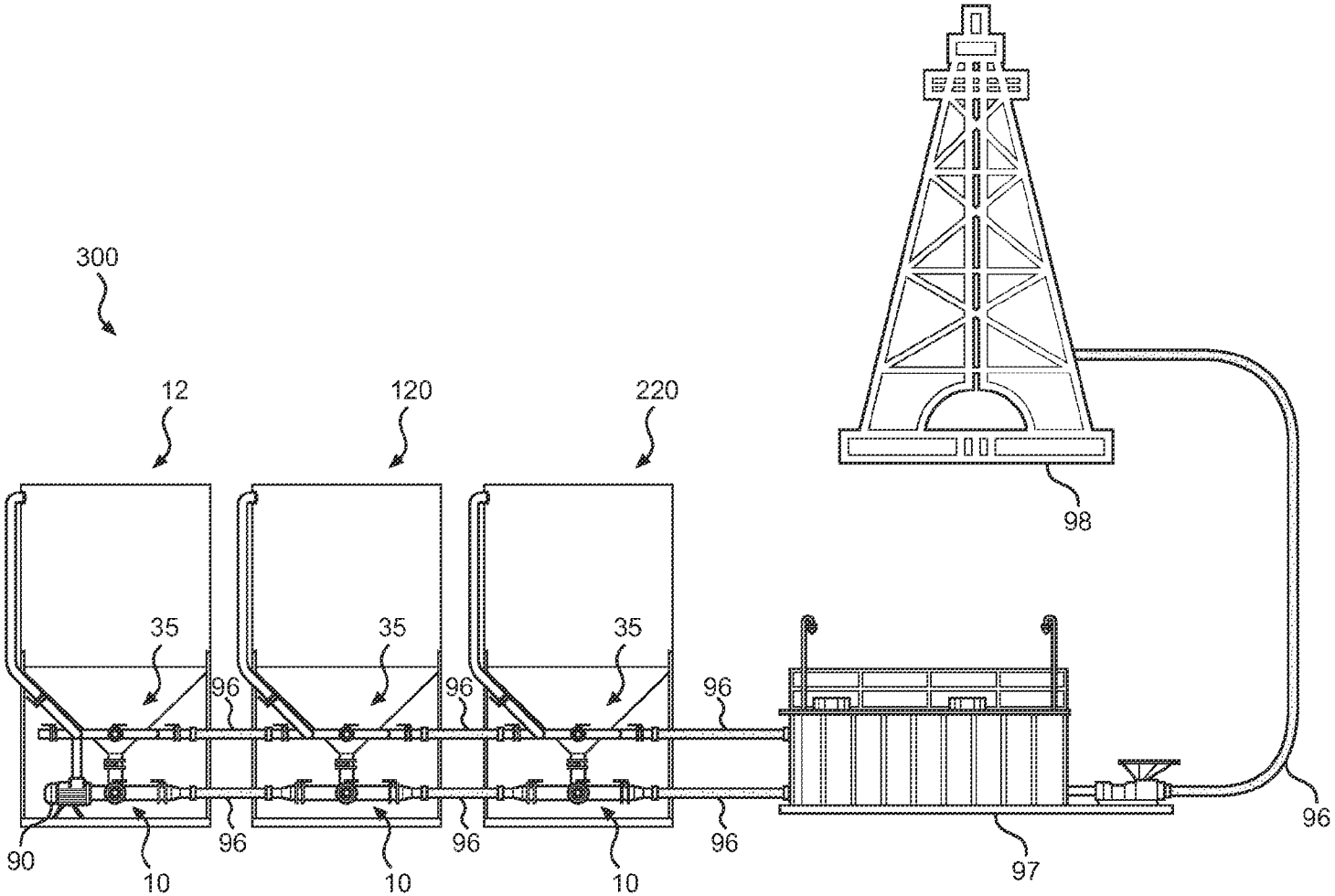
FIG. 7 is a side view of a plurality of vertical tanks in fluid communication with a drilling mud mixing station which is in turn in fluid communication with a drilling rig.

FIG. 7 is a side view of a first tank 12, a second tank 120 and a third tank 220 all of which are connected to one another by way of flexible tubing 96 between the upper manifolds 35 of each tank and by way of flexible tubing 96 between the lower manifolds 10 of each tank in order to create a tank array 300. In addition, flexible tubing 96 connects the third tank 220 to a mud mixing station 97. The mud mixing station 97 is in turn, connected to a drilling rig 98. Drilling fluid can be created in the mud mixing station 97 and delivered to each of the three tanks forming the tank array 300 through the flexible tuning 96 and the upper manifolds 35 of each of the tanks in order to be stored for later use by the drilling rig 98. When needed for use, the mud mixing station draws drilling fluid stored in the tanks 12, 120 and 220 through their respective lower manifolds 10 and into the mud mixing station 97, The drilling fluid is then drawn from the mud mixing station 97 to be used in drilling activities by the drilling rig 98. Pump 90 in the first tank 12 can be used to assist in the delivery of drilling fluid to the mud mixing station 97 or to assist in the delivery of drilling fluid to the upper manifolds 35 of the three tanks in tank array 300.

Figure 8A:
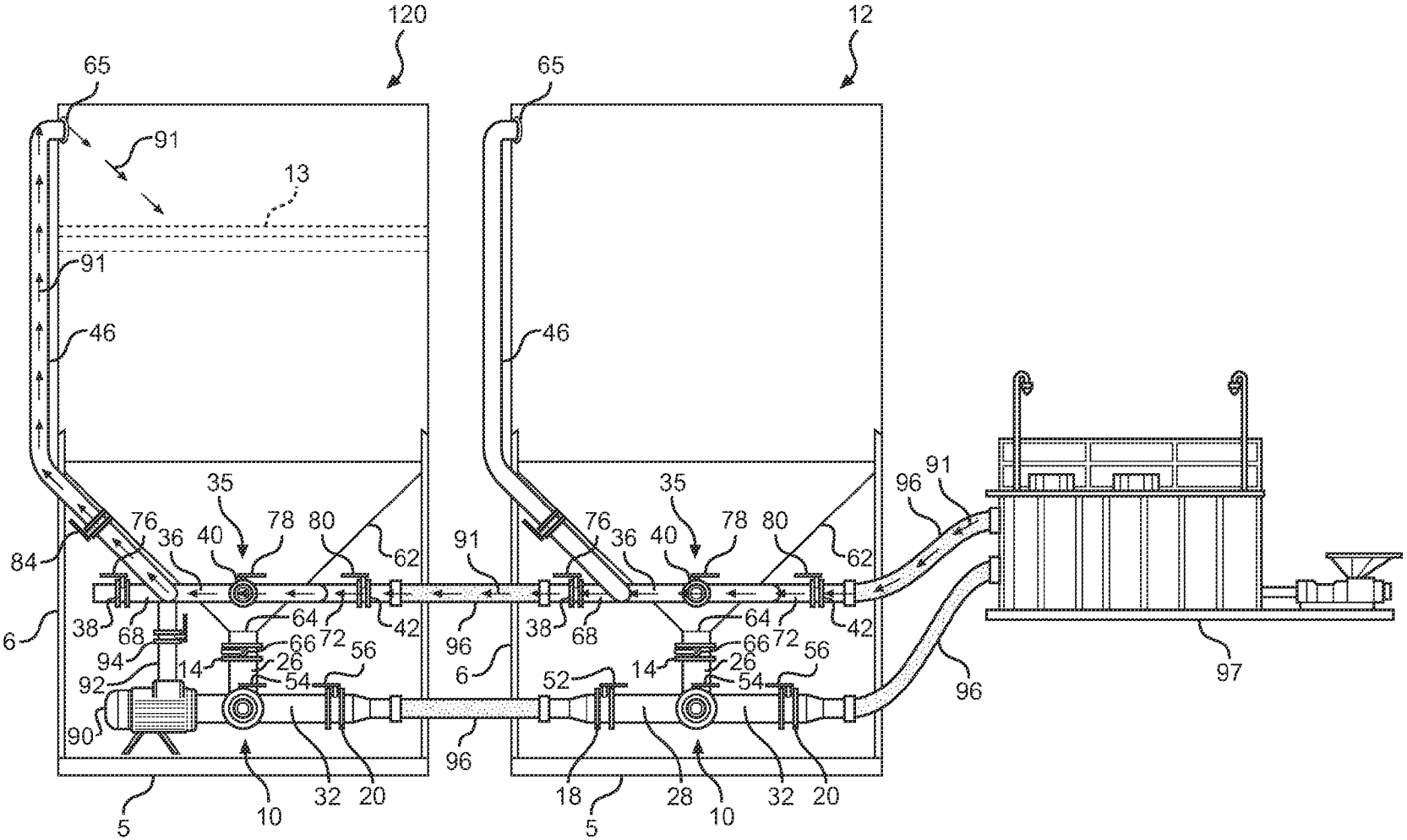
FIG. 8*a* is a side view a first vertical tank in fluid communication with a second vertical tank and is also in fluid communication with a drilling mud mixing station and showing drilling fluid being delivered from the mud mixing station to the first vertical tank by way of the upper manifold of the second vertical tank and the upper manifold of the first vertical tank.

FIG. 8*a* is a side view a first vertical tank 12 in fluid communication with a second vertical tank 120 and is also in fluid communication with a drilling mud mixing station 97 and showing the pathway 91 of flow of a material, such as drilling fluid, being delivered from the mud mixing station 97 to the second vertical tank 120 by way of the upper manifold 35 of the first vertical tank 12 and the upper manifold 35 of the second vertical tank 120. Upper conduit 72 of the first tank 12 is connected to the mud mixing station 97 by way of a flexible tubing 96. Lower conduit 32 is also connected to the mud mixing station 97 by way of a flexible tubing 96. Upper conduit 68 of the first tank 12 is connected to upper conduit 72 of the second tank 120 by way of a flexible tubing 96. Similarly, lower horizontal conduit 28 of the first tank is connected to the lower horizontal conduit 32 of the second tank 120 by way of flexible tubing 96, Once so connected, the upper manifolds 35 of both the first tank 12 and second tank 120 are each in fluid communication with the mud mixing station 97 and the lower manifolds 10 of both the first tank 12 and second tank 120 are each in fluid communication with the mud mixing station 97. Also, the second tank 120 is equipped with a pump. Pump conduit 92 connects and is in fluid communication with the upper manifold 35 and the lower manifold 10. In order to pass material, such as drilling fluid, from the mud mixing station 97 to the second tank 120, upper conduit valves 76 and 80 of the first tank 12 are each placed in the open position with all other valves in the first tank 12 placed in the closed position. In the second tank 120, upper conduit valve 80 and upper vertical conduit valve 84 are in the open position with all other valves in the second tank 120 in the closed position. Once so configured, material can pass from the mud mixing station 97 along pathway 91 through the upper manifold 35 of the first tank 12 and into the upper manifold 35 of the second tank 120, through the upper vertical conduit 46 and through inlet 65 and into the second tank 120, filling the tank 120 to level.

Figure 8B:
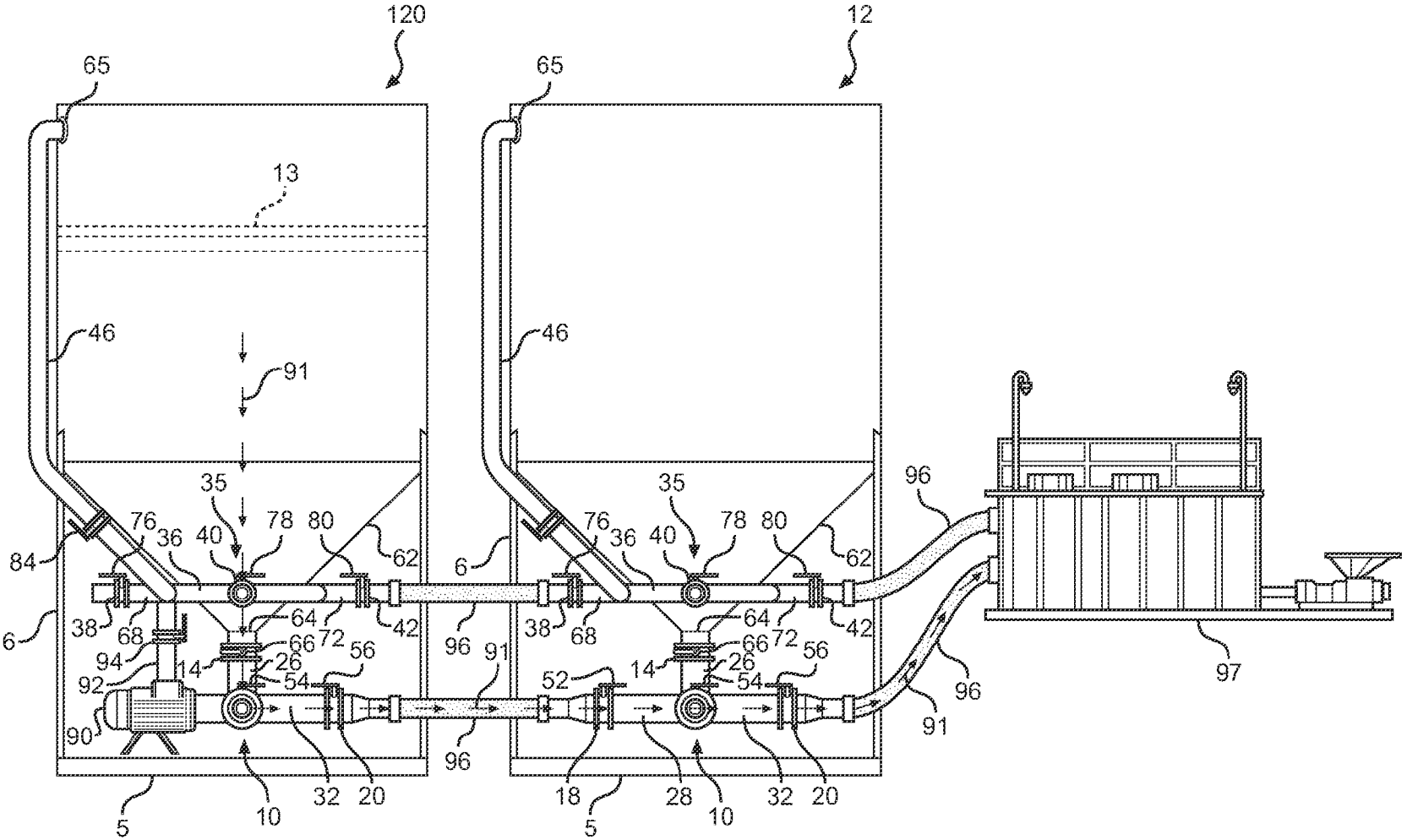
FIG. 8*b* is a side view a first vertical tank in fluid communication with a second vertical tank and is also in fluid communication with a drilling mud mixing station and showing drilling fluid being delivered to the mud mixing station from the first vertical tank by way of the lower manifold of the first vertical tank and the lower manifold of the second vertical tank.

Turning to FIG. 8*b*, in order to deliver material from the second tank 120 to the mud mixing station 97, the lower vertical conduit valve 66 and the lower conduit valve. 56 of the second tank are placed in the open position with all other valves in the second tank 120 placed in the closed position. Next, the lower conduit valves 52 and 56 of the first tank 12 are placed in the open position with all other valves in the second tank placed in the dosed position. Once so configured, material can flow along pathway 91 through the outlet 64 of the second tank, into the lower vertical conduit 26, then into the lower horizontal conduit 32 of the second tank, then into the flexible tubing 96, then into the lower horizontal conduit 28 of the first tank 12 until it exits the first tank 12 through the lower horizontal conduit 32 until the material reaches the mud mixing station 97. Once at the mud mixing station 97, the material can be used by a drilling rig 99 (shown in FIG. 7).

Figure 8C:
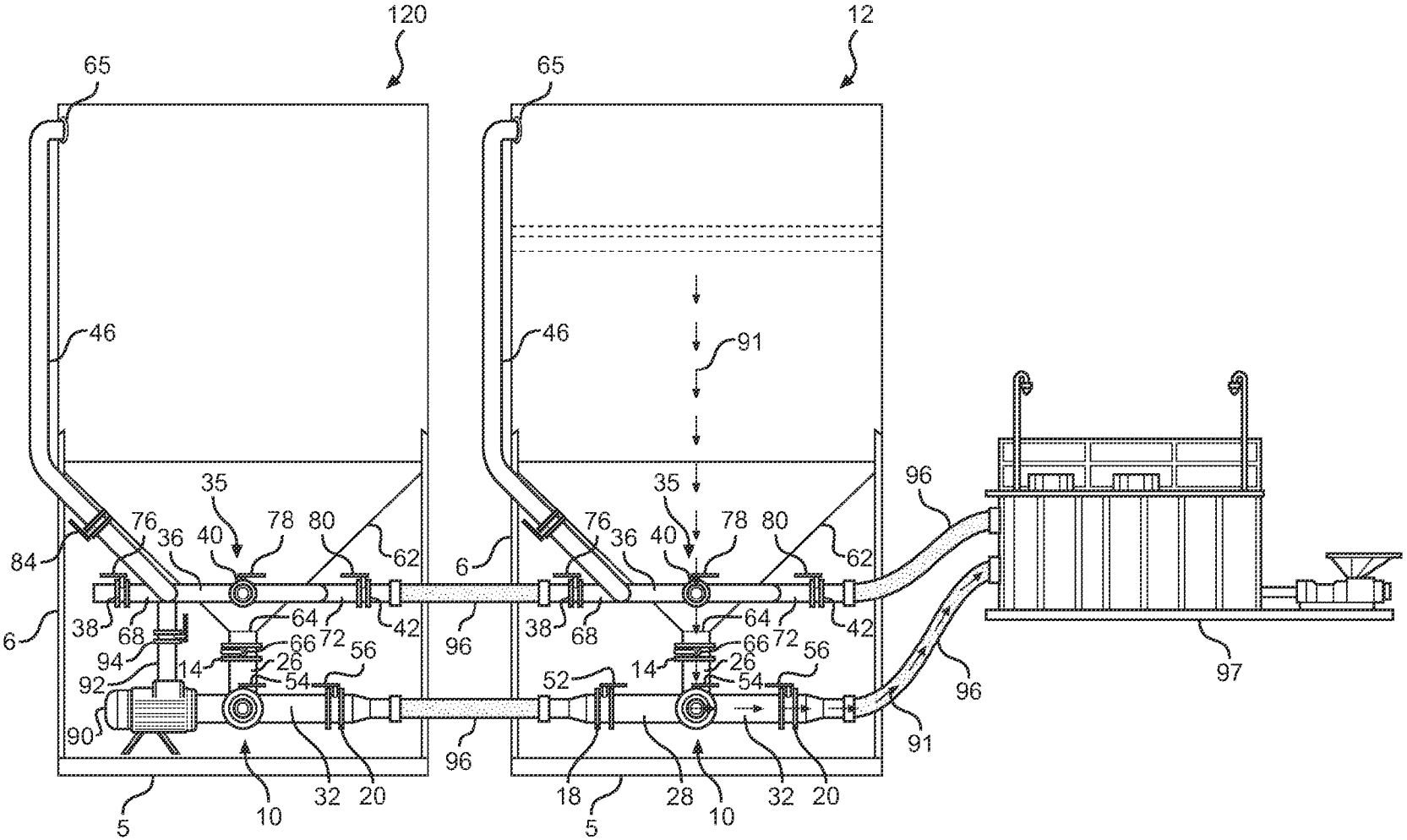
FIG. 8*c* is a side view of a first vertical tank in fluid communication with a second vertical tank and is also in fluid communication with a drilling mud mixing station and showing drilling fluid being delivered to the mud mixing station from the second vertical tank by way of the lower manifold.

Turning to FIG. 8*c*, after all material has been delivered from the second tank 120 to the mud mixing station 97, material can then be delivered from the first tank 12 to the mud mixing station 97. To switch the flow of material to the mud mixing station 97 from the second tank 120 to the first tank 12, lower vertical conduit valve 66 and lower conduit valve 56 of the second tank 120 are dosed. Next, in the first vertical tank 12 lower conduit valve 52 is dosed and the lower vertical valve 66 is placed in the open position. Once so configured, material can flow along pathway 91 through the outlet 64 of the first tank, into the lower vertical conduit 26, then into the lower horizontal conduit 32 of the first tank, then into the flexible tubing 96 until the material reaches the mud mixing station 97. Once at the mud mixing station 97, the material can be used by a drilling rig 99 (not show)

Figure 8D:
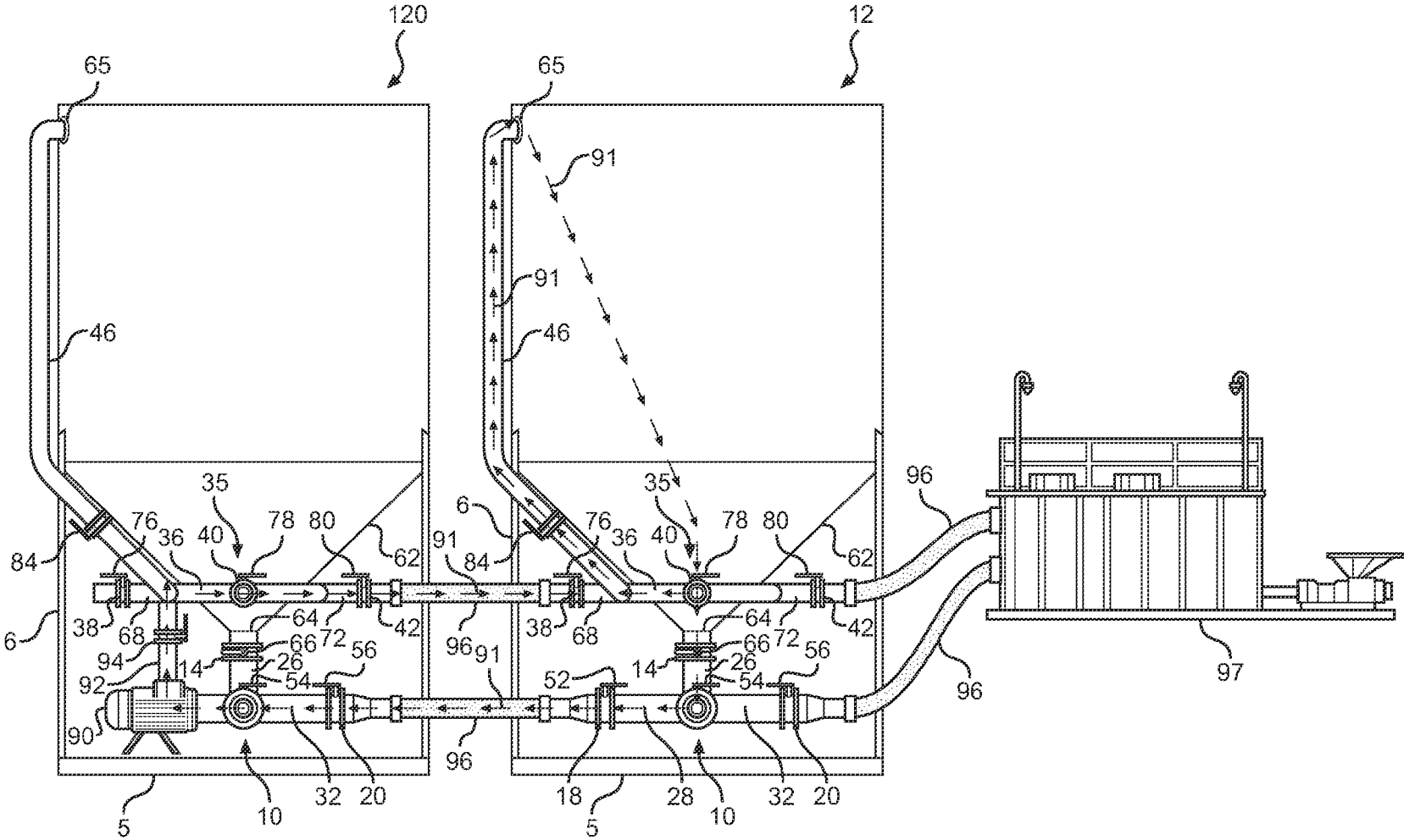
FIG. 8*d* is a side view of a first vertical tank in fluid communication with a second vertical tank and is also in fluid communication with a drilling mud mixing station and showing a cleaning cycle of the second vertical tank using the lower manifold, pump and upper manifold of the first vertical tank and the upper manifold and lower manifold of the second vertical tank.

Once the tanks 12 and 120 had delivered their stored material to the mud mixing station 97, it may be necessary to clean the tanks 12 and 120. Turning to FIG. 8*d*, a cleaning cycle for the first tank 12 is generally depicted using the pump 92 of the second tank. First a cleaning solution is introduced into the second tank 120 (see generally FIG. 6A) Next, the second tank 120 should be configured to have lower conduit valve 56, pump conduit valve 94, and upper conduit valve to be in the open position with all other valves in the second tank 120 in the close position. The first tank 12 should be configured with the upper conduit valve 76, the upper vertical conduit valve 84, the lower vertical conduit valve 66 and the lower horizontal conduit valve 28 all in the open position. Once so configured, pump 90 can be activated to draw the cleaning fluid along pathway 91 from the first tank 12, into the upper vertical conduit until the fluid exists the first tank 12 from the lower horizontal conduit 28 and into the flexible tubing 96. The material is then drawn by the pump 90 into the lower manifold 10 of the second tank 120 at the lower horizontal conduit 32 along the pathway 91, through the pump 90 and the pump conduit 92 into the upper manifold 35 of the second tank 120. The fluid then exits the upper conduit 72 of the second tank 120 into a flexible tubing 96 until it reaches the upper conduit 68 of the upper manifold 35 of the first tank. The cleaning fluid then travels up through the upper vertical conduit 46 until it re-enters the first tank 12 at the inlet 65, thereby completing a circulation loop. The pump 90 continues to circulate the cleaning fluid along pathway 91 until the first tank 12 is clean. Unlike conventional tanks used in the oil and gas industry, no persons are required to enter into the first tank to complete the cleaning cycle. The various valves of the first 12 and second tank 120 can be configured as set forth above to then conduct a cleaning cycle in the second tank 120 again without the need to have persons physically enter the first tank 12. The cleaning cycles disclosed herein allow for a substantial reduction in time for cleaning, such as when drilling operations require a switch from water based drilling mud to oil based drilling mud.

Figure 9:
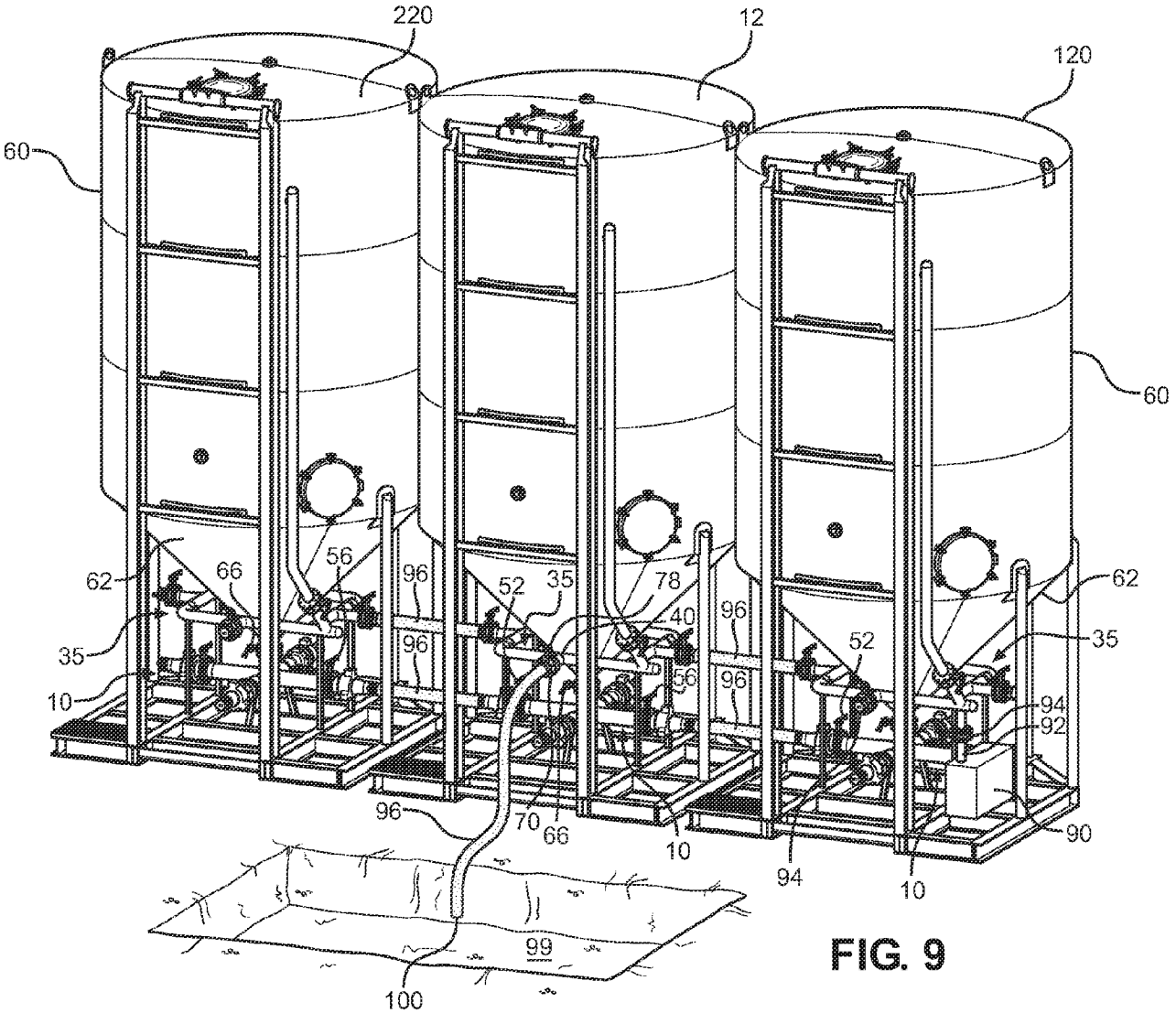
FIG. 9 is a perspective view of a tank array of vertical tanks connected together with flexible tubing at the upper manifold and the lower manifold.

FIG. 9 is a perspective view of a first tank 12 in between a second tank 120 and third tank 220, and collectively arranged to form a tank array 300 with a flexible tubing 96 connected to the a tank array 300. Drilling mud 100 is shown being released from the lower manifold 10 of the first tank 12 into a mud pit 99. It is to be appreciated by those skilled in the art that oil based drilling mud is frequently discharged into mud pits. Conventional tanks need to be manually cleaned with persons operating inside of the tank to remove the remaining oil based mud. The present invention allows quick discharge of any remaining oil based drilling mud into the mud pit 100 through use of the lower manifolds 10 of each of the tanks 12, 120, and 220 and the flexible tubing 96 connecting the same in combination with the upper manifolds 35 of each of the tank 12, 120, and 220. Use of the pump 90 shown on second tank 120 can help facilitate drawing the drilling mud 100 from each of the tanks 12, 120 and 220. For example, FIG. 9 depicts a flexible tubing 96 connected to the upper horizontal conduit 70 at the upper horizontal conduit connector 40. On each of the tanks, each of the lower vertical conduit valves 66 are placed in the open position, allowing drilling mud 100 to pass from the tanks into the lower manifolds 10. Lower conduit valve 56 of rank 220, lower conduit valves 52 and 56 of tank 12, and lower conduit valve 52 of tank 120 are also placed in the open position. Next, the pump conduit valve 94 of tank 120 is also placed in the open position to enable the pump 90 to draw the drilling mud 100 through the lower manifolds 10 of each of the tanks into the upper manifold 35 of tank 120. The pump 90 then pushes the drilling mud 100 from the upper manifold 35 of tank 120 to the upper manifold 35 of tank 12 by way of the flexible tubing 96, Finally, the pump 90 pushes the drilling mud 100 out of the upper conduit 70 through the flexible tubing 96 to a mud pit 99. Thus, the combination the upper manifolds 35, lower manifolds 10, and pump allowed the tanks 12, 120 and 220 to be quickly drained of drilling mud 100 without the need for persons to enter the tanks to remove any remaining drilling mud 100 by hand. The tanks 12, 120, and 220 are then ready to be quickly moved from one drilling location to the next to be filled with a water based drilling mud whereas conventional tanks typically used in the oil and gas industry would still be in the slow process of being cleaned by hand to ensure total removal of the drilling mud 100.

As shown in the Figures, the various manifolds are connected via flexible tubing 96 that allows fluids to flow between the various vertical tanks 12. It is contemplated that rigid pipe or conduit may be used in the connection of the tanks, and that any desired flow pattern may be established between the various manifolds of the vertical tanks 12. The flow patterns depicted herein are merely meant to be illustrative of how the upper manifold and lower manifolds can be used in combination with cone bottom tanks and a pump to fill, drain, or clean either an individual tank or an array of tanks.

It will be appreciated from the foregoing description that a plurality of tanks having the present lower manifold 10 and/or upper manifold 35 included therewith may be arranged to provide a variety of flow patterns into and out of the tank. For example, the presence of four lower horizontal conduits in the of the manifolds, in some embodiments of the present device, allows for ease of connecting flow paths between tanks with minimal repositioning of the tanks, and allows a user to take maximum advantage of a plurality of tanks when factors at a job site limit the placement of tanks in the area.

The use of various upper conduit horizontal and vertical and lower conduit horizontal and vertical valves in association with the plurality of conduits associated with the lower manifold or upper manifold also allow for creation of custom flow paths through a variety of tanks in a wide variety of configurations. Fluid exiting one tank may be directed to a second tank, or divided among more than one other tank. Alternatively, fluid exiting one tank may be combined with the flow from a second tank to increase the amount of fluid ultimately delivered by the plurality of tanks. Fluid from a first tank may be directed to the manifold of a second tank, for example, where the fluid exiting the second tank combines with the stream from the first tank. In addition, fluid from one tank may be directed to the upper manifold of a second tank, so that the first tank is used to maintain or increase the level of fluid in the second tank. A variety of combinations of connections and fluid paths is made possible by the present invention.

It is further contemplated that fluid may be delivered from, or received into, any given tank via either of the upper or lower manifolds and the associated conduits as set forth in detail above. External pumps can be used in lieu of a pump integrated into the tank.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

While there have been shown what are presently considered to be preferred embodiments of the present invention, it will be apparent to those skilled in the art that various changes and modifications can be made herein without departing from the scope and spirit of the invention. Accordingly, the invention is not to be limited as except by the appended claims.

What is claimed is:

1. A vertical tank comprising:

a tank having a cylindrical upper section having a radius and a conical lower section extending from the cylindrical upper section to a bottom;

an outlet in the conical lower section and centered at the bottom of the conical lower section; and a lower manifold having a lower vertical conduit in fluid communication with the outlet of the tank with a first end and an opposing second end, the first end connected to the outlet such that the opposing second end extends downward directly beneath the outlet, a plurality of lower horizontal conduits directly connected to and extending away from the second end of the lower vertical conduit, each having a length and each terminating in an end and in fluid communication with the lower vertical conduit, wherein the length is less than the radius, a lower vertical conduit valve connected to and in fluid communication with the lower vertical conduit, and a plurality of lower horizontal conduit valves corresponding in number to the plurality of lower horizontal conduits wherein each lower horizontal conduit valve is connected to and in fluid communication with one of the lower horizontal conduits an upper manifold having a central conduit surrounding a perimeter of the conical lower section;

a plurality of upper horizontal conduits connected to and extending away from the central conduit, terminating in an end and in fluid communication with the central conduit;

an upper vertical conduit with a first end connected to and in fluid communication with the central conduit and a second end connected to and in fluid communication with an inlet in the cylindrical upper section of the tank;

an upper vertical conduit valve in fluid communication with the upper vertical conduit and located on the upper vertical conduit between the central conduit and the inlet of the tank; and a plurality of upper horizontal conduit valves in fluid communication with the plurality of upper horizontal conduits, wherein the plurality of upper horizontal conduit valves corresponds in number to the plurality of upper horizontal conduits and wherein each upper horizontal conduit valve is connected to one of the upper horizontal conduits.

2. The vertical tank of claim 1 further comprising a pump having a pump conduit connected adjacently to and in fluid communication with the central conduit of the upper manifold and connected adjacently to and in fluid communication with one of the plurality of the lower horizontal conduits of the lower manifold.

3. The vertical tank of claim 2 wherein the pump conduit has a pump conduit valve to control flow of a material between the upper manifold and the lower manifold.

4. A vertical tank array comprising:

a first vertical tank and a second vertical tank, the first vertical tank and the second vertical tank each having a cylindrical upper section and a conical lower section extending from the cylindrical upper section to a bottom;

an outlet in the conical lower section and centered at the bottom of the conical lower section;

a base connected to the tank by a frame wherein the base is in contact with a ground surface;

a lower manifold having a lower vertical conduit in fluid communication with the outlet of the tank with a first end and an opposing second end, the first end connected to the outlet, a plurality of lower horizontal conduits connected to and extending away from the second end of the lower vertical conduit, each terminating in an end and in fluid communication with the lower vertical conduit, a lower vertical conduit valve in fluid communication with the lower vertical conduit, and a plurality of lower horizontal conduit valves corresponding in number to the plurality of lower horizontal conduits wherein each lower horizontal conduit valve is in fluid communication with one of the horizontal conduits, wherein the lower manifold is suspended above the ground surface by the base and the frame;

an upper manifold having a central conduit surrounding a perimeter of the conical lower section, a plurality of upper horizontal conduits connected to and extending away from the central conduit, terminating in an end and in fluid communication with the central conduit, an upper vertical conduit with a first end connected to and in fluid communication with the central conduit and a second end connected to and in fluid communication with an inlet in the cylindrical upper section of the tank, an upper vertical conduit valve in fluid communication with the upper vertical conduit and located between the central conduit and the inlet of the tank, a plurality of upper horizontal conduit valves corresponding in number to the plurality of upper horizontal conduits wherein each upper horizontal conduit valve is in fluid communication with one of the upper horizontal conduits; and a flexible tubing connecting the upper manifold of the first vertical tank to the upper manifold of the second vertical tank such that upper manifolds of the first vertical tank and the second vertical tank are in fluid communication with one another through the flexible tubing.

5. The vertical tank array of claim 4 wherein one of the plurality of tanks further comprises a pump in fluid communication with the lower manifold and the upper manifold of each of the plurality of tanks.

6. A method of moving material in a vertical tank comprising the steps of:

(1) providing a first vertical tank comprising a tank having a cylindrical upper section and a conical lower section extending from the cylindrical upper section to a bottom, with a material stored within the tank;

an outlet in the conical lower section and centered at the bottom of the conical lower section;

a base connected to the tank by a frame wherein the base is in contact with a ground surface;

a lower manifold having a lower vertical conduit in fluid communication with the outlet of the tank with a first end and an opposing second end, the first end connected to the outlet such that the opposing second end extends downward directly beneath the outlet, a plurality of lower horizontal conduits directly connected to and extending away from the second end of the lower vertical conduit, each having a length and each terminating in an end and in fluid communication with the lower vertical conduit, wherein the length is less than the radius, a lower vertical conduit valve connected to and in fluid communication with the lower vertical conduit, and a plurality of lower horizontal conduit valves corresponding in number to the plurality of lower horizontal conduits wherein each lower horizontal conduit valve is connected to and in fluid communication with one of the lower horizontal conduits, wherein the lower manifold is suspended above the ground surface by the base and the frame;

(2) connecting the first lower horizontal conduit of the first vertical tank to a mud mixing station via a flexible tubing;

(3) placing the first horizontal conduit valve in the open position;

(4) placing the second horizontal conduit valve in a closed position;

(5) placing the lower vertical conduit valve in an open position; and (6) using the mud mixing station to draw the drilling fluid from the first vertical tank to the mud mixing station through the outlet, the lower vertical conduit, the first horizontal conduit and through the flexible tubing (7) providing a second vertical tank comprising a tank having a cylindrical upper section and a conical lower section extending from the cylindrical upper section to a bottom, with a material stored within the tank;

a base connected to the tank by a frame wherein the base is in contact with a ground surface;

an outlet in the conical lower section and centered at the bottom of the conical lower section;

a lower manifold having a lower vertical conduit in fluid communication with the outlet of the tank with a first end and an opposing second end, the first end connected to the outlet, a plurality of lower horizontal conduits connected to and extending away from the second end of the lower vertical conduit, each terminating in an end and in fluid communication with the lower vertical conduit, a lower vertical conduit valve connected to and in fluid communication with the lower vertical conduit, and a plurality of lower horizontal conduit valves corresponding in number to the plurality of lower horizontal conduits wherein each lower horizontal conduit valve is connected to and in fluid communication with one of the lower horizontal conduits, wherein the lower manifold is suspended above the ground surface by the base and the frame;

(8) connecting the second lower horizontal conduit of the first vertical tank to the first lower horizontal conduit of the second vertical tank via a second flexible tubing;

(9) placing the second horizontal conduit valve from the closed position to an open position;

(10) placing the vertical conduit valve of the second vertical tank in an open position;

(11) placing the first lower horizontal conduit valve of the second vertical tank in a closed position; and

(12) placing the second lower horizontal conduit valve of the second vertical tank in a closed position; and

(13) using the mud mixing station to draw the material from the second vertical tank to the mud mixing station through the outlet of the second vertical tank, the lower vertical conduit of the second vertical tank, the first lower horizontal conduit of the second vertical tank, the second flexible tubing, the second lower horizontal conduit of the first vertical tank, the first lower conduit of the first vertical tank, and through the flexible tubing.

7. The vertical tank of claim 1 wherein the plurality of lower horizontal conduits is four.

8. The vertical tank of claim 1 wherein each of the plurality of lower horizontal conduits has a means for connecting a flexible tubing or an additional conduit.

9. The vertical tank of claim 1 wherein each of the plurality of upper horizontal conduits has a means for connecting a flexible tubing or an additional conduit.

10. The vertical tank of claim 1 wherein the plurality of upper horizontal conduits is four.

11. The vertical tank array of claim 4 wherein the plurality of lower horizontal conduits in the first vertical tank is four and wherein the plurality of lower horizontal conduits in the second vertical tank is four.

12. The vertical tank array of claim 4 wherein the central conduit of the first vertical tank extends around a perimeter of the conical lower section of the first vertical tank and wherein the central conduit of the second vertical tank extends around a perimeter of the conical lower section of the second vertical tank.

13. The vertical tank array of claim 4 wherein the plurality of upper horizontal conduits in the first vertical tank is four and where the plurality of upper horizontal conduits in the second vertical tank is four.

14. The vertical tank array of claim 4 further comprising a third vertical tank having a cylindrical upper section and a conical lower section extending from the cylindrical upper section to a bottom;

an outlet in the conical lower section and centered at the bottom of the conical lower section;

a lower manifold having a lower vertical conduit in fluid communication with the outlet of the tank with a first end and an opposing second end, the first end connected to the outlet, a plurality of lower horizontal conduits connected to and extending away from the second end of the lower vertical conduit, each terminating in an end and in fluid communication with the vertical conduit, a lower vertical conduit valve in fluid communication with the lower vertical conduit, and a plurality of lower horizontal conduit valves corresponding in number to the plurality of lower horizontal conduits wherein each lower horizontal conduit valve is in fluid communication with one of the horizontal conduits;

a flexible tubing connecting the lower manifold of the second vertical tank to the lower manifold of the third vertical tank such that the lower manifolds of the first vertical tank, the second vertical tank and the third vertical tank are in fluid communication with one another through the flexible tubing connecting the first vertical tank to the second vertical tank and the flexible tubing connecting the second vertical tank to the third vertical tank.

* * * * *